United States Patent [19]

Young

[11] Patent Number: 4,480,883

[45] Date of Patent: Nov. 6, 1984

[54] ANTI-TIP BLOCKING DEVICE

[75] Inventor: William W. Young, Newmarket, Canada

[73] Assignee: Office Specialty Division of Hollanding Inc., Holland Landing, Canada

[21] Appl. No.: 506,006

[22] Filed: Jun. 20, 1983

[30] Foreign Application Priority Data

Feb. 25, 1983 [CA] Canada ..... 422380

[51] Int. Cl.[3] ..... E65B 65/46

[52] U.S. Cl. ..... 312/220; 312/216

[58] Field of Search ..... 312/215–222, 312/333

[56] References Cited

U.S. PATENT DOCUMENTS 108,874 11/1870 Brown ..... 312/221
4,298,236 11/1981 Laroche ..... 312/221
4,355,851 10/1982 Slusser ..... 312/215

FOREIGN PATENT DOCUMENTS 1037093 8/1978 Canada ..... 312/215
1037092 8/1978 Canada ..... 312/215

*Primary Examiner*—William E. Lyddane
*Assistant Examiner*—Joseph Falk
*Attorney, Agent, or Firm*—Brant Latham

[57] ABSTRACT

An anti-tip blocking device is disclosed for preventing the opening of more than one file drawer in a file cabinet at the same time. The device includes a plurality of locking bars and cam elements vertically stacked in a vertical channel one upon the other alternately to slide vertically therein. The cam elements are engaged by pins carried by the file drawers whereby opening of any file drawer requires additional vertical space in the channel to be occupied. With the free vertical space in the channel limited to the space required for the opening of one drawer, once any one drawer is opened, no other drawer may be opened. The improvement disclosed involves providing each cam element with a cylindrical bearing surface to contact the vertical channel so that the cam element is vertically slidably in the channel while being rotatable about the axis of the cylindrical bearing surface.

23 Claims, 8 Drawing Figures

FIG. 4.
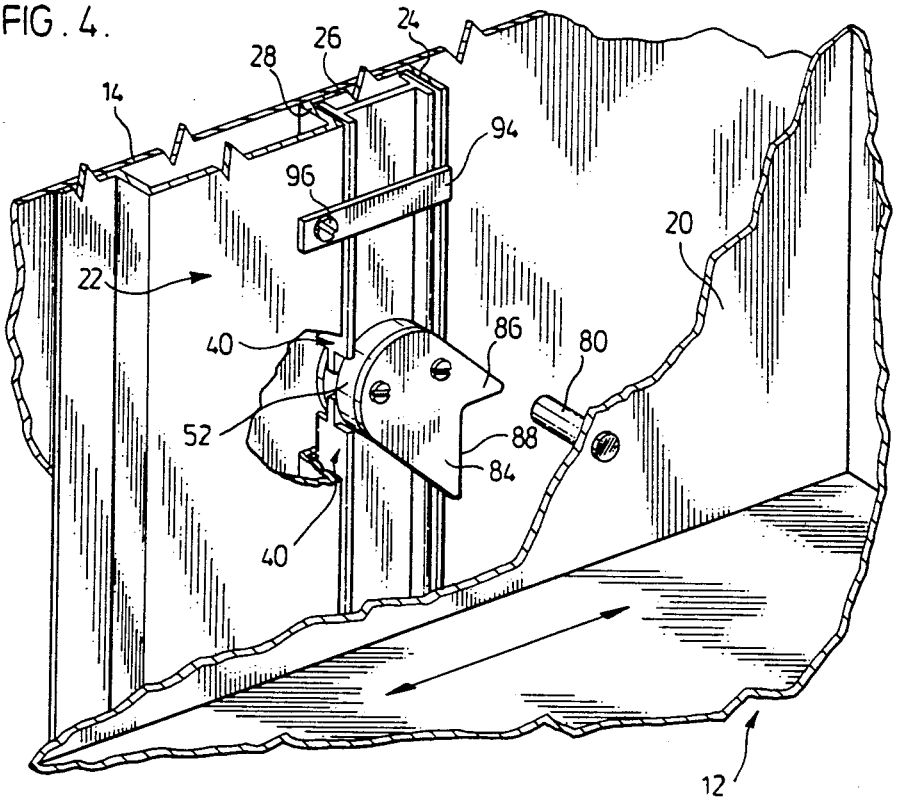
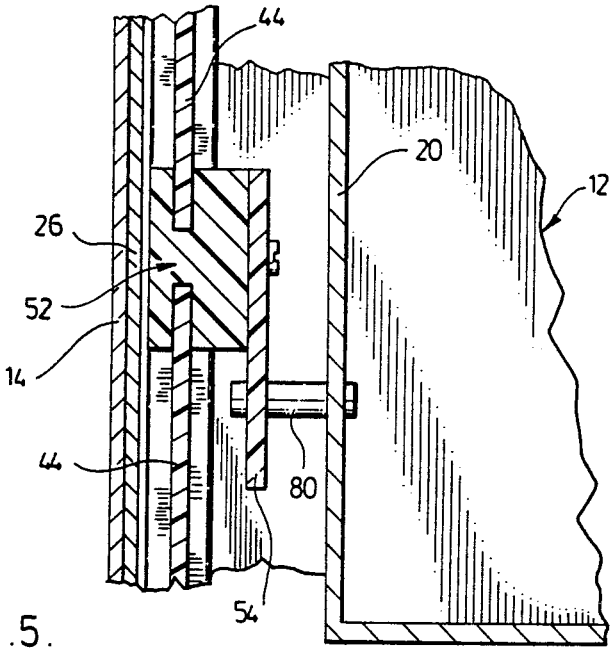
FIG. 5.

ANTI-TIP BLOCKING DEVICE

BACKGROUND OF THE INVENTION

This invention relates generally to anti-tip blocking devices for storage systems and more particularly to an improved anti-tip blocking device for file cabinets to prevent the opening of more than one file drawer.

A known danger of conventional filing cabinets with a number of horizontally slidable file drawers is that if more than one of the drawers may be pulled out at the same time, the cabinet may tip over. This inherent hazard is particularly true where one file drawer may be heavily loaded. Another inherent danger arises where the cantilevered weight of an opened drawer, while not sufficient in itself to cause the cabinet to tip over, may cause the cabinet to assume a forwardly inclined attitude so that other drawers may, due to gravity, roll from a closed to an open position causing the cabinet to thereby tip over.

A number of anti-tip devices are known for filing cabinets to prevent more than one file drawer from being opened at one time. One known type provides a number of floating locking bars which are stacked to slide vertically within a vertical channel. In such systems, the total vertical space in the channel within which the stacked bars are free to move is limited. Means are provided whereby opening of any drawer required additional vertical space in the channel to be occupied. With the free vertical space in the channel limited to the space required for the opening of one drawer, once any one of the drawers is opened, insufficient vertical space then remains for any other drawer to be opened at the same time.

Known anti-tip systems with such floating locking bars include the systems disclosed in Canadian Pat. No. 1,037,093 issued Aug. 22, 1978 and Canadian Pat. No. 1,114,883 issued Dec. 22, 1981. In the system of Canadian Pat. No. 1,037,093 each locking bar has a cam element secured to its lower end and journalled to the locking bar for rotation in relation thereto. In the system of Canadian Pat. No. 1,114,833 between each stacked locking bar a rotatable cam element is provided which cam element is secured and journalled to the channel in which the locking bars are slidably retained. The systems of both these patents have the disadvantages that they require cam elements to be secured to. and journalled for rotation to either the locking bars or the channel retaining the locking bars, thereby occasioning complicated assembly and expense in manufacture.

SUMMARY OF THE INVENTION

Accordingly, it is an object of the present invention to at least partially overcome the disadvantages of the prior art devices by providing an anti-tip blocking device wherein locking bars and rotatable cam elements are alternately stacked one upon the other to slide vertically within a channel.

Another object is to provide an improved anti-tip blocking system of a simplified construction.

A further object is to provide a simplified construction for an anti-tip blocking device which prevents more than one file cabinet drawer from being opened at any one time as well as preventing any two or more drawers from being opened simultaneously.

Accordingly, in one of its aspects the present invention provides a safety lock system for use in vertically stacked slidably retained storage elements for preventing the opening of more than one element at a time, the system comprising:

a plurality of locking bars and a plurality of cam elements being vertically slidable in a vertical support guide means alternately stacked in vertical alignment one upon the other for limited vertical displacement therein defined by the vertical support guide means;

each cam element having a cylindrical bearing surface to contact the vertical support guide means so that the cam element is vertically slidably retained by the guide means while rotatable about the axis of the cylindrical bearing surface between:

(i) a first neutral position in which first cam portions of the cam element space opposed ends of adjacent locking bars alternating therewith by a first displacement distance, and (ii) a second extended position in which second cam portions of the cam element space opposed ends of the adjacent locking bars by a second displacement distance a predetermined distance greater than the first displacement distance;

the limited vertical displacement and the predetermined distance being selected so that only one cam element can be in an extended position at any one time;

an engaging member coupled to each of the storage elements to engage and displace an activating arm portion of an associated cam element rotating the cam element between its neutral and extended positions by displacement of the storage element between closed and open positions thereof.

In accordance with the present invention an anti-tip blocking system is provided for storage units having vertically stacked, slidable storage elements retained therein. In the system, locking bars and cam elements are provided stacked one upon another in alternating arrangement within a vertical support guide means or channel. The locking bars and cam elements are individually and collectively vertically slidable within the vertical support guide means for limited vertical displacement therein as defined by the vertical support guide means.

Each cam element has a cylindrical bearing surface adapted to contact said vertical support guide means so that the cam element while being vertically slidably retained by the guide means is rotatable about the axis of said cylindrical bearing surface from a first neutral position, in which first cam portions of the cam element space opposed ends of adjacent locking bars alternating with the cam element by a first displacement distance, to a second extended position, in which second cam portions of the cam the cam element space the opposed ends of the adjacent locking bars by a second displacement distance a predetermined distance greater than the first displacement distance. This predetermined distance and the extent of limited vertical displacement of the locking bars and cam elements are selected so that only one cam element can assume an extended position at any one time. Thus with all the cam elements in a neutral position, any one cam element may then be rotated to an extended position, whereupon all locking bars and cam elements above the rotated cam element are raised said predetermined distance and there remains insufficient vertical space within the guide means to permit any additional cam element from being rotated from a neutral to an extended-locking position.

An engaging member is provided for each of the storage elements coupled to the storage elements so as, upon movement of the storage elements between open and closed positions, to engage and displace an activating arm portion of a cam element associated with each engaging element, rotating the cam element between the neutral and extended positions.

In an assembled anti-tip blocking system according to the present invention, with all the storage elements in a closed position and with each cam element in a neutral position, upon at least partial opening of one storage element, the engaging member coupled thereto engages and displaces the activating arm of an associated cam element, rotating that cam element to its extended position and blocking the remaining cam elements from rotation to an extended position. The remaining cam elements blocked into a neutral position, upon attempted opening of any of the remaining storage elements, by the engagement of engaging members carried by the remaining storage elements with respective actuating arm portions of the cam elements, effectively block substantial opening of the remaining storage elements carrying engaging members.

In a preferred embodiment of the present invention, the vertical support guide means may comprise a simple U-shaped channel with both the cylindrical body portion of the cam element carrying the cylindrical bearing surface and the locking bars being disposed in this channel stacked with end surfaces of the locking bar contacting and bearing on cam portions of the cam elements. Alternative arrangements include more complex channel-like members with, for example, a first channel portion to slidably but rotatably receive merely the cylindrical body of the cam element which first channel portion may open into a second adjacent channel portion which receives in stacked vertical alignment cam portions of each cam element and bearing surfaces of each locking bar in contact therewith. Many variations may occur to those skilled in the art.

Preferred cam portions according to the present invention to space bearing surfaces of adjacent locking bars comprise opposite sides of a portion of rectangular cross-section centered on the axis of the cylindrical body portion. The difference in length of the sides of the rectangle provides for the difference in spacing of ends of adjacent locking bars between neutral and extended positions of the cam element. With diagonal corners of the rectangle being radially farther from the axis of the cylindrical bearing surfaces than any other point on the perimeter of the rectangle, an inherent bias exists against the cam element inadvertently rotating between the neutral and extended positions. Many cross-sectional profiles may be used for the cam portion other than rectangular profiles. Exemplary profiles include, eliplitical, oval and triangular profiles. The shapes must have one dimension therethrough larger than another dimension. Preferably the shape may have a configuration to aid the prevention of accidental rotation of cam elements from between neutral and extended positions.

In the preferred embodiments of the present invention, the locking bars comprise straight members having centrally located, flat end surfaces to bear the weight of the locking bars and mate with cam portions of the cam element. The bearing surfaces need not be flat but alternatively may comprise any shape to cam on cam portions of the cam elements.

BRIEF DESCRIPTION OF THE DRAWINGS

Further objects and advantages of the invention will appear from the following description taken together with the accompanying drawings in which:

FIG. 4 shows the anti-tip blocking device of FIG. 1 in a partially cut-away pictorial view from the inside of a filing cabinet with a cam element in a neutral position;

FIG. 5 is a cross-sectional front view through the anti-tip blocking device of FIG. 4 looking rearward from a vertical plane in which the axis of the cylindrical portion of the cam element lies;

Figure 1:
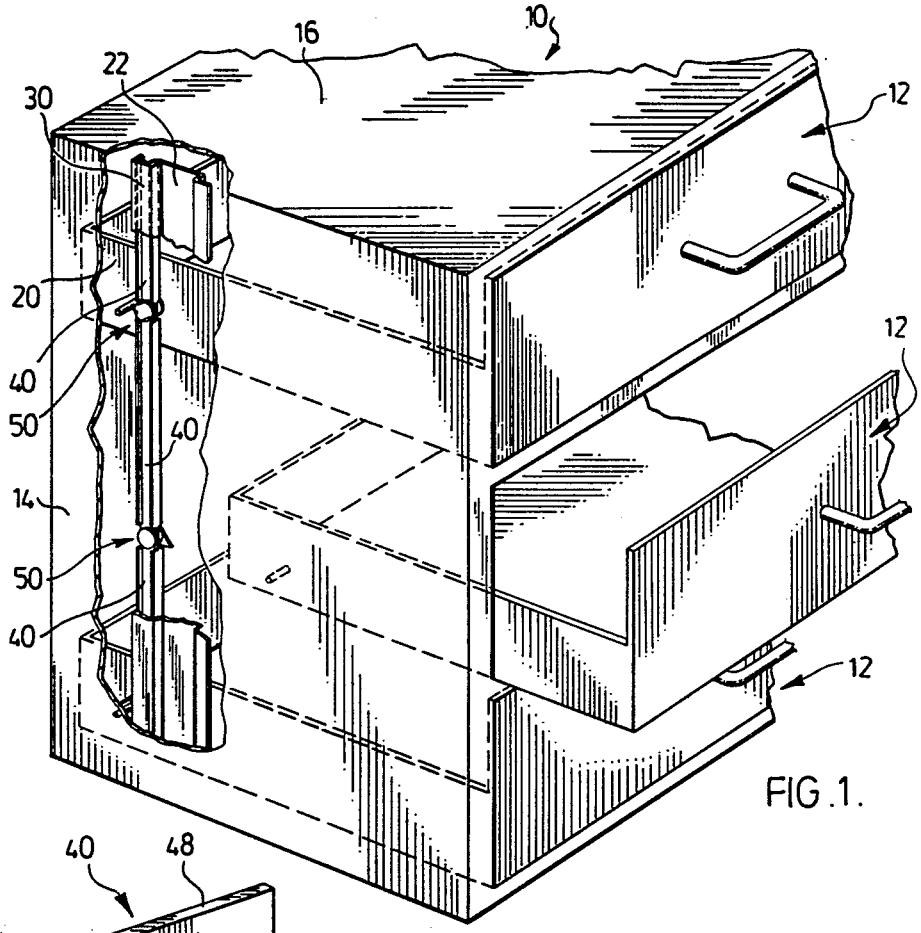
FIG. 1 is a partial pictorial view of a lateral filing cabinet partially cut-away to show an anti-tip blocking device according to the present invention.
Figure 6:
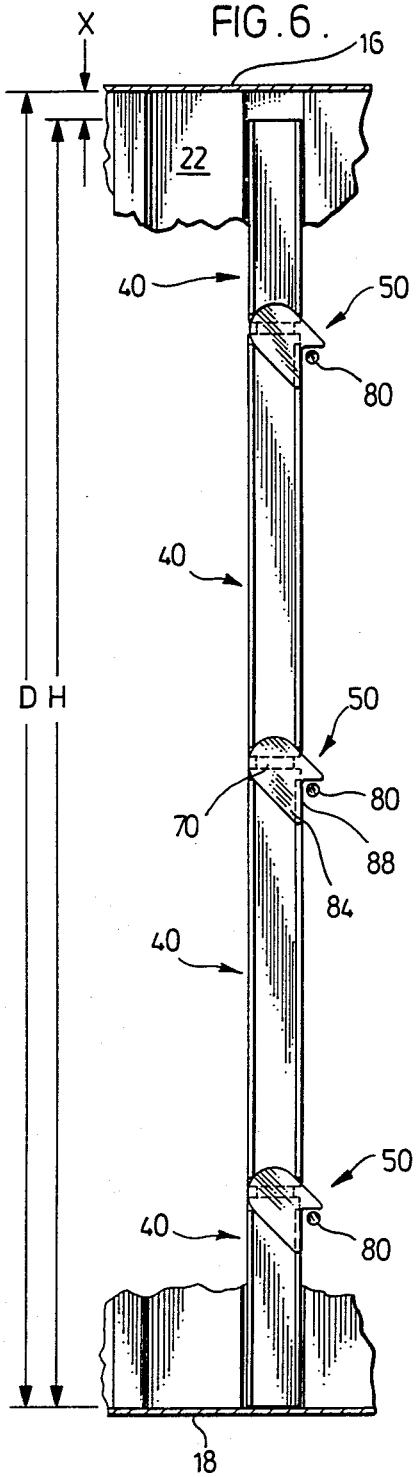
FIG. 6 is a schematic side view from inside the file cabinet of FIG. 1 showing the cam elements and locking bars with all the file drawers in a closed position.
Figure 7:
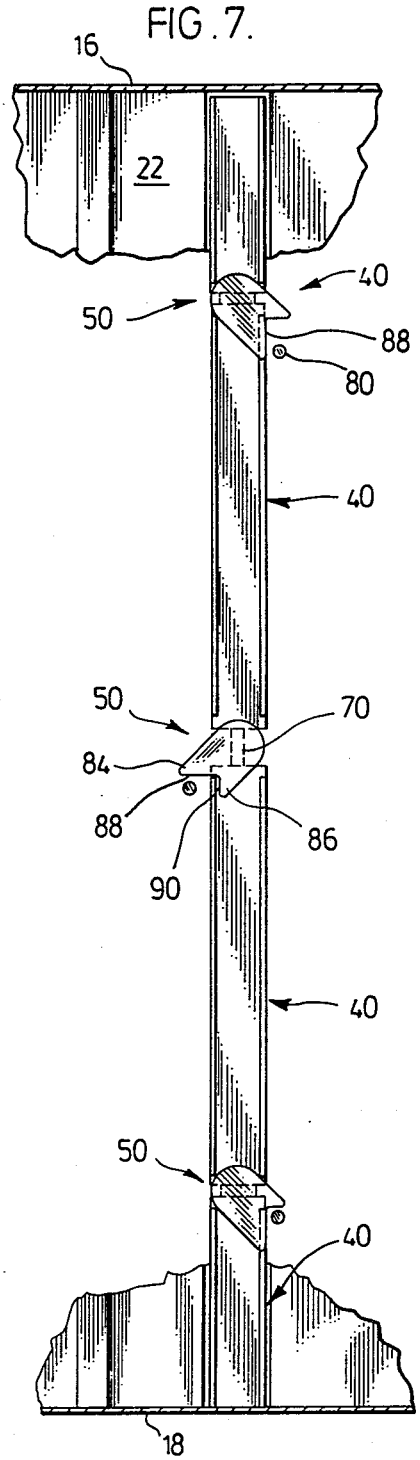
FIG. 7 is a view identical to FIG. 6 but with a middle file drawer having been partially opened in a manner similar to that shown in FIG. 1.

Reference is now made to FIG. 1 which shows a file cabinet 10 having three horizontally slidable file drawers 12. The cabinet 10 is shown of a conventional sheet-metal construction and has side walls, one of which is shown in FIG. 1 as 14, a top wall 16 and a bottom wall 18 as shown in FIGS. 6 and 7. The file drawers 12 are horizontally slidable in file cabinet 10 by conventional guide means, not shown, which typically comprise telescoping cooperating channels, one channel being coupled to the interior of the side walls 14 of cabinet 10 and the other channel being coupled to side wall 20 of the file drawer 12.

Secured to the inside surface of each side wall 14 of cabinet 10 is a vertical structural member 22 which in accordance with the preferred embodiment of the present invention defines vertical support guide means, namely a U-shaped channel 30 having rear arm 24, base 26 and forward arm 28. In the preferred embodiment, channel 30 extends from the bottom wall 18 of cabinet 10 to the cabinet's top wall 16.

Located within channel 30 are locking bars 40 and cam elements 50. As may best be seen in FIGS. 6 and 7, locking bars 40 and cam elements 50 are stacked one upon the other in channel 30 with each locking bar 40 alternating with a cam element 50.

Figure 2:
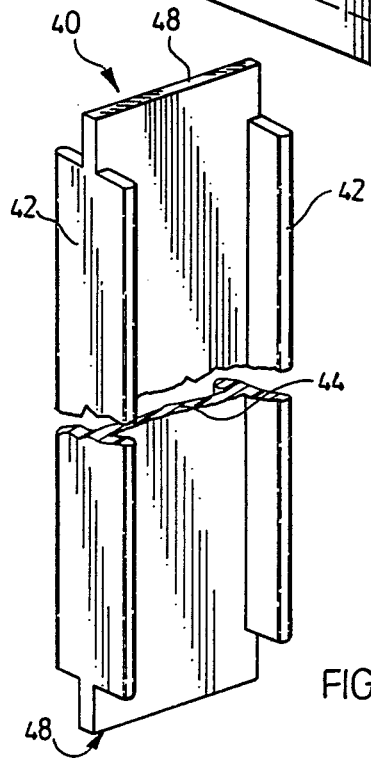
FIG. 2 is a pictorial view of a preferred locking bar according to the present invention.

A preferred locking bar 40 according to the present invention is shown in FIG. 2 to have an H-shaped cross-section with lateral flanges 42 joined by central web 44.

Figure 3:
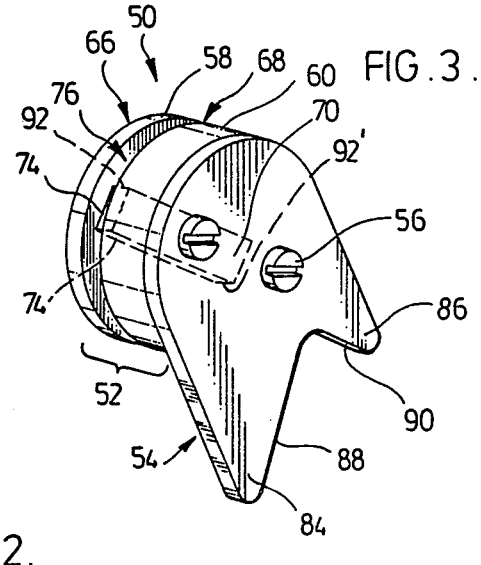
FIG. 3 is a pictorial view of a preferred cam element according to the present invention.

A preferred form of a cam element 50 according to the present invention shown in FIG. 3. Each cam element 50 comprises a cylindrical body portion 52 and an activating arm portion 54 coupled together, for example, by screws 56. The cylindrical body portion has cylindrical bearing surfaces 58 and 60 which are carried by two co-axial disc-like portions of equal diameter, circular cross-section. The diameter of cylindrical body portion 52 is chosen so that with cylindrical body portion 52 disposed with its axis horizontal, the body portion 52 may be closely disposed inside channel 30 whereby cylindrical bearing surfaces 58 and 60 will bear on and cam against forward arm 28 and rear arm 24 of channel 30. This constrains cylindrical body portion 52 within channel 30 for rotational movement about its axis while permitting cylindrical body portion 52 to be free to slide vertically in channel 30 along with locking bars 40.

The two disc-like portions 66 and 68 are spaced axially from one another by an intermediate portion 70 of rectangular cross-section. In the preferred embodiment, diagonals of rectangular portion 70 intersect on the axis of cylindrical portion 52. The rectangular portion 70 has first cam surfaces 72 formed along its longer sides and second cam surfaces 74 formed along its shorter sides. The dimension of the diagonal of rectangular portion 70 is less than the diameter of cylindrical body portion 52 whereby body portion 52 has a slot 76 circumferentially extending therearound between the two disc-like portions 64 and 66. Slot 76 is of a uniform width chosen so that webs 44 of locking bars 40 may freely slide into slot 76 and end surfaces 48 of locking bars 40 may contact and bear on cam surfaces 72 and 74 of cam elements 50.

In assembly of locking bars 40 and cam elements 50 into channel 30, a lowermost locking bar 40 is placed in channel 30 resting on bottom wall 18 of cabinet 10. A lowermost cam element 50 is then placed on top of the lowermost locking bar 40 with web 44 of the locking bar 40 disposed within slot 76 whereby end surface 48 of the locking bar may contact cam surface 72 of cam element 50 to bear the weight of the cam element. Further locking bars 40 and cam elements 50 are subsequently, successively alternatively stacked one upon the other.

FIGS. 4 and 5 clearly indicate the manner in which the locking bars 40 and cam elements 50 are stacked alternatively one upon the other, each to be vertically slidable within channel 30. As may be seen in FIGS. 4 and 5, webs 44 of locking bars 40 are in vertical alignment with slots 76 of cam elements 50.

The end surface 48 of web 44 of a locking bar above a given cam element contacts uppermost first cam surface 72 while end surface 48 of web 44 of a locking bar 40 below a given cam element 50 contacts lowermost first cam surface 72. Thus, effectively, with a cam element 50 orientated in a neutral position as shown in FIGS. 4 and 5, the opposed end surfaces 48 of adjacent locking bars 40 alternating with the respective cam element 50 are vertically spaced by a first displacement distance equal to the dimension of the shorter side of rectangular portion 70.

As is to be appreciated, if a cam element 50 is rotated 90° about the axis of cylindrical body portion 52, then rectangular portion 70 will be rotated from a position in which the longest sides of the rectangular portion 70 are horizontal to a position in which the longest sides of the rectangular portion 70 are vertical. Such an extended or locking position is the position shown to be occupied by the middle cam element 50 in FIG. 7. With a cam element 50 in such an extended or locking position, the end surface 48 of web 44 of locking bar 40 above the cam element contacts an uppermost second cam surface 74 while end surface 48 of web 44 of the locking bar 40 below the cam element contacts lowermost second cam surface 74. Thus, with the cam element 50 orientated in an extended position, opposed end surfaces 48 of adjacent locking bars 40 alternating with a respective cam element 50 are vertically spaced by a second displacement distance equal to the dimension of the longer side of the rectangular portion 70, a distance greater than the displacement of the locking bars with cam element 50 in a neutral position.

As seen in FIG. 6, with all the cam elements 50 in a neutral position, that is with rectangular portions 70 lying with their longest sides horizontal, the combined height of the stacked locking bars 40 and cam elements 50 is a height H less than the distance D between bottom wall 18 and top wall 16 of the cabinet 10 by a distance X. Distance X is chosen to be marginally greater than the difference in dimension between the longer and shorter sides of rectangular portion 70, whereby to permit any one cam element to be rotated from a neutral position to an extended position. Distance X however is chosen to be insufficient to permit any two cam elements to assume an extended position at the same time. The anti-tip blocking device according to the present invention uses the aspect of only one cam element being able to assume an extended position, to prevent more than one file drawer 12 from being opened at any one time. The means provided for cam elements 50 to interact with file drawers 12 is now described.

Each file drawer 12 has an engaging element or pin 80 secured thereto. As seen in FIGS. 4 and 5, pin 80 is fixed to side wall 20 of drawer 12, as for example, by rivetting. Pin 80 extends horizontally from drawer 12 and is adapted to engage activating arm portion 54 of cam element 50.

Actuating arm portion 54 includes a fork-shaped extension having two opposed arms, first arm 84 and second arm 86. With a cam element 50 in a neutral position, an engagement surface 88 of first arm 84 assumes a substantially vertical position and is disposed in a path pin 80 assumes on the file drawer 12 sliding horizontally between open and closed positions.

FIG. 6 shows the configuration of locking bars 40, cam elements 50 and pins 80 when all file drawers 12 are in a closed position. As seen in FIG. 6, all cam elements 50 are in a neutral position and all file drawers 12 (not shown) are in a closed position as indicated by pins 80 carried by drawers 12 being located rearward of cam elements 50. On opening the middle file drawer 12, pin 80 carried thereby is moved horizontally forwardly from the position shown in FIG. 6 to engage engagement surface 88 of first arm 84 of cam element 50. Further forward movement of pin 80 via engagement with arm 84 rotates the entire cam element 50 about the axis of cylindrical body portion 52 until the middle cam element 50 is sufficiently rotated to assume its extended position. As shown in FIG. 7, with pin 80 located forwardly of the middle cam element 50, pin 80 is free to be moved further forwardly for complete opening of file drawer 12.

In the rotation of cam element 50 to its extended position, first cam surfaces 72 and particularly opposed corners 92, 92' thereof act to cam on end surfaces 48 of opposed locking bars 40 thereby raising all locking bars 40 and cam elements 50 above the rotated cam element by a distance equal to the difference between the length of the largest and shortest sides of rectangular portion 70. The uppermost locking bar is thereby raised within channel 30 sufficiently close to top wall 16 that insufficient space exists for any other cam element to be substantially rotated from a neutral position.

As seen in FIG. 7, neither of the remaining upper and lower file drawers 12 are permitted but limited forward movement towards an open position. Forward movement of these file drawers 12 is restricted by their respective pins 80 engaging surfaces 88 of the first arm 84 of associated cam elements 50. With these cam elements 50 being prevented from rotation from their neutral position to an extended position, the first arm 84 of cam elements 50 effectively prevent pins 80 from further forward horizontal movement, preventing the remaining closed file drawers 12 from being opened.

Referring still to FIG. 7, it is seen that with the middle cam element 50 rotated to the extended position, the first arm 84 of activating arm portion 54 has been rotated so that its engagement surface 88 assume an approximately horizontal position. In this extended position, the second arm 86 of the activating arm portion 54 lies in a position that its engagement surface 90 is in a substantially vertical position, in the horizontal path of pin 80 on opening and closing of file drawer 12. On closing the open middle file drawer 12, pin 80 carried thereby is moved horizontally rearward from the position shown in FIG. 7 to engage engagement surface 90 of the second arm 86 of cam element 50. Further rearward movement of pin 80 via contact with arm 86 rotates the entire cam element 50 about the axis of cylindrical body portion 52 whereby cam element 50 is sufficiently rotated to reassume its neutral position as shown in FIG. 6.

The length of first arm 84 of the activating arm portion 54 is to be chosen so that, as exemplified by the upper cam element 50 in FIG. 7, when that cam element 50 has been raised by the rotation of a lower cam element 50 to an extended position, the first arm 84 of the raised cam element 50 must be of sufficient length so as to engage pin 80 on its associated file drawer 12 and prevent the passage of pin 80 horizontally therepast.

In regard to the relative location of pin 80 and an associated cam element 50 according to the present invention, referring to FIG. 6, with file drawer 12 in a closed position, preferably pin 80 is but a marginal distance rearward of engagement surface 88 of first arm 84 so that the forward movement of file drawer 12 required for pin 80 to contact the first arm 84 is minimal. With all the file drawers 12 closed, this permits any given drawer which is to be opened to need to be moved towards an open position but a small distance in order to rotate a cam element 50 and thereby lock all other file drawers 12 from being opened. Similarly, the close location of pin 80 and first arm 84 provides for but small forward displacement of any file drawer 12 once any other file drawer 12 has been opened.

In rotating the preferred cam element 50 between its neutral and extended positions, cam surfaces 72 and 74 on rectangular portion 70 and in particular opposed corners 92, 92′ of these cam surfaces act to cam on end surfaces 48 of web 44. The selection of portion 70 to have a rectangular cross-section provides means biasing the cam element 50 to remain either in a neutral or an extended position. In the rectangular cross-section, the greatest radial extension from the axis of cylindrical body 52 is ½ the diagonal from the axis of the cylindrical body portion to a corner, for example corner 92. On rotating a cam element 50, an apex point is reached between neutral and extended positions where the diagonal between corners 92, 92′ is vertical and the blocking bars 40 above the cam element are raised a maximum distance. With cam element 50 in rotated positions immediately on either sides of the above-mentioned apex, the cam element will, due to the weight of blocking bars thereabove acting on the cam surfaces, be biased to respectively rotate to one of the neutral or extended positions. This biasing effect is aided by providing flat end surfaces 48 on web 44 which contact with cam surfaces 72 and 74.

In order for proper operation, cam surfaces 72, 74 must cam on end surfaces 48 of locking bars 40. Accordingly, in the preferred embodiment each lateral flange 42 of the locking bars 40 is cut-away at ends of the locking bars 40 adjacent a cam element 50 so that flange 42 will not contact cam element 50 and prevent end surfaces 48 of web 44 from bearing on cam surfaces 72 and 74.

As previously discussed, the diagonal of rectangular portion 70 is less than the diameter of cylindrical body portion 52 so that slot 76 extends fully around the cylindrical body portion 52. This circumferential extension of slot 76 ensures that in all rotational positions of cam element 50, web 44 of the locking bar 40 will be retained within slot 76 due to the weight of locking bars 40, thereby retaining webs 44 and slot 76 in vertical alignment.

Means may be provided to maintain the locking bars 40 within U-shaped channel 30. FIG. 4 shows an example of a simple securing bar 94 bridging channel 30 and secured to structural member 22 by a screw 96. In conventional filing cabinets, the guide means by which the file drawers 12 are horizontally slidable may also extend across the mouth of channel 30 and aid retention of locking bars 40 therein.

The operation of the anti-blocking system of the present invention has been described with particular reference to FIGS. 6 and 7. It is to be appreciated that with all the file drawers 12 in a closed position opening any one of the file drawers 12 will rotate its associated cam element 50 and prevent the remaining file drawers 12 from being opened.

Should, for example, any of the file drawers in a system not wish to be blocked from being opened when another file drawer is opened, this may be accomplished by removing the cam element 50 normally to be associated with that file drawer 12 and extending the length of the locking bars 40 to make up the space occupied by the removed cam element 50 in a neutral position.

The anti-block system according to the present invention prevents simultaneous opening of two or more file drawers 12, in that with only sufficient vertical space being provided in channel 30 for one cam element 50 to be in an extended position, in attempting to open two file drawers 12 simultaneously, neither cam elemeht 50 will be able to be rotated to an extended position and both file drawers will thereby be prevented from being opened.

The locking bars 40 according to the present invention are preferably made of plastic material which has low-coefficient of friction, smooth external surfaces to aid the sliding of bars 40 within channel 30. Cam elements 50 may preferably also be fabricated from plastic material with low-coefficients of friction on cylindrical bearing surfaces 58 and 60 to facilitate rotation and sliding of cam element 50 within channel 30. While the cylindrical body portion 52 may be formed from a cylindrical rod with slot 76 suitably cut therefrom and a separate activating arm portion 54 secured thereto, the cam element 50 may also advantageously be moulded as a unitary component.

Figure 8:
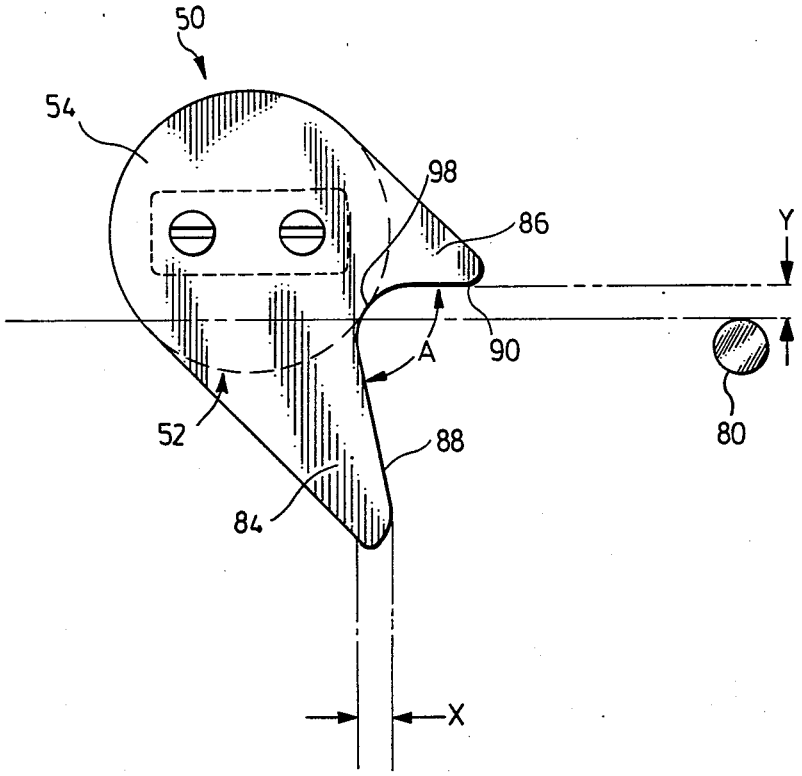
FIG. 8 is a side view of a preferred cam element comprising a modified form of the cam element shown in FIGS. 3 to 7.

FIGS. 3 to 7 illustrate embodiments of the present invention with a cam element as most clearly shown in FIG. 3. FIG. 8 illustrates a cam element identical to that shown in FIG. 3 but with advantageous modifications having been made to the activating arm portion. Throughout the drawings, with particular reference to FIGS. 3 and 8, the same reference numerals designate similar elements.

The activating arm portion 54 of cam element 50 shown in FIG. 8 has engagement surface 88 of first arm 84 forming an angle A of approximately 80° with the engagement surface 90 of second arm 86. This is to be contrasted with the cam element 50 shown in FIG. 3 in which the angle between arm 84 and arm 86 is approximately 90°.

With all file drawers 12 closed, engaging pin 80 may be provided at a vertical height a small distance Y below horizontal engagement surface 90 of second arm 86. The distance Y is preferably chosen to be marginally greater than a distance X', representing the horizontal distance as shown in FIG. 8 between the forwardmost and rearwardmost points on engagement surface 88. This arrangement permits pin 80, on horizontal movement forwardly to the left as a file drawer is opened, by sliding along the length of arm 84 to ensure that the cam element 50 is fully rotated 90° to an extended position.

While the engagement surfaces 88 and 90 have been shown in the preferred embodiments to be straight, many other shapes are suitable including arcuate or curved engagement surfaces. Similarly, the angle between engagement surfaces and the orientation of the engagement surfaces in neutral and extended positions may be selected to be other than as shown in these preferred embodiments.

In preferred forms of the present invention, the vertical position of each engaging pin 80 with respect to the vertical position of a cam element 50 is to be selected having regard to the configuration of the cam element whereby preferably on the engaging pin moving between open and closed positions and contacting the cam element, only the interaction of the rectangular portion 70 and the end surface 48 of a locking bar 40 lifts the cam element. Thus, preferably, the engaging pin 80 does not contact surfaces of the cam element in a manner so as to lift the rectangular portion 70 off the end surface 48 of the locking bar 40 therebelow. In effect, preferably the engaging pin 80 only imparts rotation to the cam element 50 and the only lifting of the cam element 50 arises due to the camming of rectangular portion 70 on end surfaces 48. With these considerations in mind, the cam element 50 shown in FIG. 8 was designed with the engagement surfaces 88 and 90 merging as a radial portion 98 located sufficiently close to the axis of cylindrical body portion 52 to ensure the rectangular portion 70 is not lifted off end surface 40 of the locking bar 40 on movement of engagement pin 80 between open and closed positions.

In the embodiment shown in FIGS. 6 and 7, the locking bars 40 and cam elements 50 are free to slide within channel 30. Preferably, a spring means may be provided to bias the uppermost lock bar 40 downward. During shipment or rough handling of a file cabinet containing the anti-tip blocking system, a suitable spring means would bias the locking bars and cam elements together to reduce the chance of any of the lock bars and cam elements becoming disengaged with each others as might occasion failure of the system. Suitable spring means could include a coil spring disposed between the end of the uppermost lock bar and top wall 16.

The preferred embodiment of FIGS. 6 and 7 show a lowermost locking bar 40 supported by the bottom wall 18 and the uppermost locking bar 40 to be raised to engage top wall 16. An advantageous modification is to provide stop members such as angle iron members (not shown) securely fixed within channel 30 to define the upper and lower limits of movement of lock bars 40. Advantageously, when forming vertical structural member 22, predetermined markings may be made to indicate suitable locations for such stop members a fixed distance apart.

The preferred embodiment shows a lowermost locking bar 40 slidably disposed in the bottom of channel 30. In that the lowermost lock bar not required to be raised in the operation of the anti-tip blocking device, the lowermost lock bar 40 may be secured to the channel 30 or may be substituted by other means suitably vertically located within channel 30 having equivalence to end surface 48 of the lowermost locking bar 40.

Single elongate rigid locking bars 40 have been shown between alternate cam elements 50 to locate cam elements 50 at suitable heights with respect to pins 80 on file drawers 12. Alternatively, for example, a number of locking bars could be provided.

An uppermost locking bar 40 has been shown in the preferred embodiment in channel 30 between the uppermost cam element 50 and top wall 16. As one alternative, this uppermost locking bar could be secured to the channel in a raised position, particularly if suitable means are provided to ensure vertical alignment of the locking bar and cam element. Other embodiments, as may occur to a person skilled in the art utilizing different configurations for the channel 30, may be able to eliminate all together the upper or lowermost locking bars with, for example, cam surfaces on the cam element extending radially a greater extent than the cylindrical body of the cam element so that the cam surfaces themselves may contact the top wall 16 of the file cabinet.

Although the disclosure describes and illustrates preferred embodiments of the invention, it is not limited to these particular embodiments. Many variations and modifications will now occur to those skilled in the art. For a definition of the invention reference is made to the appended claims.

The embodiments of the invention in which an exclusive property or privilege is claimed are defined as follows:

1. A safety lock system for use in vertically stacked slidably retained storage elements for preventing the opening of more than one element at a time, said system comprising:

a plurality of locking bars and a plurality of cam elements being vertically slidable in a vertical support guide means alternately stacked in vertical alignment one upon the other for limited vertical displacement therein defined by said vertical support guide means;

each cam element having a cylindrical bearing surface to contact said vertical support guide means so that the cam element is vertically slidably retained by the guide means while rotatable about the axis of said cylindrical bearing surface between:

(i) a first neutral position in which first cam portions of the cam element space opposed ends of adjacent locking bars alternating therewith by a first displacement distance, and (ii) a second extended position in which second cam portions of the cam element space opposed ends of said adjacent locking bars by a second displacement distance a predetermined distance greater than said first displacement distance;

said limited vertical displacement and said predetermined distance being selected so that only one cam element can be in an extended position at any one time;

an engaging member coupled to each of said storage elements to engage and displace an activating arm portion of an associated cam element rotating said cam element between its neutral and extended positions by displacement of the storage element between closed and open positions thereof, wherein with all of said storage elements carrying engaging members being in a closed position and with said cam elements being in a neutral position, upon at least partial opening of one storage element, the engaging member coupled thereto engages and displaces an activating arm portion of an associated cam element rotating the associated cam element to its extended position preventing the remaining cam elements from rotation to extended positions whereby respective actuating arm portions of the remaining cam elements upon engagement by engaging elements block opening of remaining storage elements carrying engaging elements.

2. A system as claimed in claim 1 wherein with all said storage elements carrying engaging members in a closed position and with said cam elements in a neutral position, upon at least partial opening of one storage element, the engaging member coupled thereto engages and displaces an actuating arm portion of an associated cam element rotating the associated cam element to its extended position whereby all cam elements and blocking bars thereabove are raised said predetermined distance eliminating vertical displacement within said vertical support guide means sufficient to permit rotation of any remaining cam elements from a neutral position to an extended position whereby the respective activating arm portions of the remaining cam elements upon engagement by engaging members block opening of the remaining storage elements carrying engaging members.

3. A system as claimed in claim 1 wherein with all said storage elements in a closed position and with said cam elements in a neutral position, upon at least partial opening of one storage element, the engaging member coupled thereto engages and displaces an activating arm portion of an associated cam element rotating the associated cam element to its extended position whereby all cam elements and blocking bars thereabove are raised said predetermined distance eliminating vertical displacement within said vertical support guide means sufficient to permit rotation of any remaining cam elements from a neutral position to an extended position whereby with attempted opening of a remaining storage element carrying an engaging member an actuating arm portion of a cam element is engaged by such engaging member and the actuating arm portion blocks passage of such engaging member therepast effectively preventing opening of the remaining storage elements carrying engaging members.

4. A system as claimed in claim 4 wherein said vertical support guide means is a support channel vertically securable adjacent a side wall of said stacked storage elements.

5. A system as claimed in claim 4 wherein said support channel comprises a U-shaped channel member opening towards said side wall of said stacked storage elements adjacent thereto.

6. A system as claimed in claim 1 wherein said cam element is slidably retained in said vertical support guide means with said axis of the cylindrical bearing surface horizontally disposed normal to a direction in which said storage elements are slidable for opening and closing.

7. A system as claimed in claim 5 wherein said cam element is slidably retained in said vertical support guide means with said axis of the cylindrical bearing surface horizontally disposed normal to a direction in which said storage elements are slidable for opening and closing.

8. A system as claimed in claim 1 wherein said engaging member is a pin secured to a storage element and extending outwardly of one side wall thereof in alignment to engage said actuating arm portion of said cam element.

9. A system as claimed in claim 7 wherein said engaging member is a pin secured to a storage element and extending outwardly of one side wall thereof in alignment to engage said actuating arm portion of a cam element.

10. A system as claimed in claim 9 wherein said activating arm portion is located on an axial end of the cam element closest to said side wall of a storage element and includes a radial extension of said cam element from said axis.

11. A system as claimed in claim 1 wherein said activating arm portion comprises a forkshaped member having two opposed arms, each said opposed arm being engageable by an engaging member of an associated storage element during movement of said storage element from a closed position to an open position and from an open position to a closed position, respectively.

12. A system as claimed in claim 10 wherein said activating arm portion comprises two opposed arms radially extending from said axis, each arm being engageable by an engaging member of an associated storage element during movement of said storage element between a closed position and an open position and between an open position and a closed position, respectively.

13. A system as claimed in claim 1 including means to bias said cam element to remain in said neutral position and means to bias said cam element to remain in said extended position.

14. A system as claimed in claim 13 wherein said means to bias comprise flat surfaces provided on each of said first and second cam portions for contact with flat supporting surface portions on ends of adjacent blocking bars spaced by a cam element.

15. A system as claimed in claim 1 wherein said cam element including a cam segment thereof with a camming surface extending circumferentially about said axis, said camming surface having first diametrically opposed surface portions comprising said first cam portions and second diametrically opposed surface portions comprising said second cam portions circumferentially displaced with respect to the first diametrically opposed surface portions.

16. A system as claimed in claim 1 wherein each cam element includes a portion of rectangular cross-section with diagonals thereof intersecting at the axis of said cylindrical bearing surface, surfaces of larger sides of the rectangular portion comprising said first cam portions and surfaces of the smaller size of the rectangular portion comprising said second cam portion.

17. A system as claimed in claim 3 wherein each cam element includes a portion of rectangular cross-section with diagonals thereof intersecting at the axis of said cylindrical bearing surface, surfaces of larger sides of the rectangular portion comprising said first cam portions and surfaces of the smaller size of the rectangular portion comprising said second cam portion.

18. A system as claimed in claim 1 wherein said cam element comprises a substantially cylindrical body carrying said cylindrical bearing surface, said body comprises two disc-like cylindrical segments of equal diameter, uniformly spaced along said axis one from the other by a rectangular portion with diagonals thereof intersecting at said axis, whereby with the rectangular portion having lesser extension radially from said axis then the cylindrical segments, a circumferential slot is defined between said cylindrical segments, surfaces of larger sides of the rectangular portion comprising said first cam portions and surfaces of smaller sides of the rectangular portion comprising said second cam portions, said locking bars having an H-shaped crosssection with a central web and lateral flanges, said vertical support guide means comprising a U-shaped channel member, the locking bars and cylindrical body of the cam element being received in said U-shaped channel member with the web of the locking bar in vertical alignment with said circumferential slot to be slidably received therein, portions of the lateral flanges of the locking bars being cut-away proximate ends of the locking bars so that the lateral flanges do not interfere with the central web bearing on and contacting said first and second cam portions.

19. A system as claimed in claim 18 wherein said activating arm portion of said cam element comprises an axial extension of the cylindrical body having a greater radial extension from said axis than the cylindrical bearing surfaces.

20. A system as claimed in claim 19 wherein said cam element is formed as a unitary body comprising said cylindrical body and said activating arm portion.

21. A system as claimed in claim 1 wherein said locking bars are elongated straight members.

22. A system as claimed in claim 1 wherein said slidable storage elements are file drawers, said drawers being secured on guide rails in a filing cabinet having opposed side walls, a top wall and bottom wall, said guide means being secured vertically to one of said cabinet side walls.

23. A system as claimed in claim 1 wherein said lock bars and cam elements are disposed one stacked upon the other when all said storage elements are in a closed position with said cam elements in a closed position to thereby provide a free space between the top of the uppermost of said lock bars and cam elements and an upper limit of said vertical support guide means whereby, opening one of said storage elements horizontally displaces its engaging member to engage and displace an activating arm portion of a cam element rotating said cam element from a neutral position to an extended position and elevating lock bars and cam elements thereabove so that said free space is substantially occupied by the top of the uppermost one of said lock bars and cam elements.

* * * * *